US006488473B1

(12) United States Patent
Lee et al.

(10) Patent No.: US 6,488,473 B1
(45) Date of Patent: Dec. 3, 2002

(54) RETAINING ARRANGEMENT FOR ROTOR BLADES OF AXIAL-FLOW TURBOMACHINERY

(75) Inventors: Stuart Lee, Berlin (DE); Peter Broadhead, Mickleover Derby (GB); Tim Hopp, Berlin (DE)

(73) Assignee: Rolls-Royce Deutschland Ltd & Co KG, Dahlewitz (DE)

( * ) Notice: Subject to any disclaimer, the term of this patent is extended or adjusted under 35 U.S.C. 154(b) by 0 days.

(21) Appl. No.: 09/666,145

(22) Filed: Sep. 20, 2000

(30) Foreign Application Priority Data

Dec. 17, 1999 (DE) ..... 199 60 896

(51) Int. Cl.[7] ..... F01D 5/32

(52) U.S. Cl. ..... 416/220 R; 416/204 A; 416/248

(58) Field of Search ..... 416/219 R, 220 R, 416/204 A, 248

(56) References Cited

U.S. PATENT DOCUMENTS

| | | | | |
|---|---|---|---|---|
| 4,432,555 A | | 2/1984 | Langley | |
| 4,470,756 A | | 9/1984 | Rigo et al. | |
| 4,566,857 A | * | 1/1986 | Brumen | 416/220 R |
| 4,730,983 A | * | 3/1988 | Naudet et al. | 416/220 R |
| 4,846,628 A | | 7/1989 | Antonellis | |
| 4,921,405 A | * | 5/1990 | Wilson | 416/241 R |
| 5,007,800 A | * | 4/1991 | Hacault et al. | 416/220 R |
| 5,173,024 A | | 12/1992 | Mouchel et al. | |
| 5,256,035 A | * | 10/1993 | Norris et al. | 416/220 R |

FOREIGN PATENT DOCUMENTS

| | | |
|---|---|---|
| DE | 2549649 C3 | 5/1976 |
| EP | 0463955 B1 | 9/1994 |
| EP | 0761930 B1 | 10/1999 |

* cited by examiner

*Primary Examiner*—Edward K. Look
*Assistant Examiner*—Ninh Nguyen
(74) *Attorney, Agent, or Firm*—The Law Offices of Timothy J. Klima

(57) ABSTRACT

This invention relate to a retaining arrangement for rotor blades of axial-flow turbomachinery which features blade roots slots on a rotor disk for the accommodation and radial fixation of roter blades and which further features a continues, circumferential retaining ring for the axial fixation of the rotor blades in the blade root slots and a locking arrangement for the axial retention of the retaining ring. The retaining arrangement is characterized in that the retaining ring has recesses which correspond with sections of the blade root slots and projecting sections on its outer circumference. The present invention provides a cost-effective retaining arrangements for blade of axial-flow turbomachinery which provides for better control of the leakage flows in the blade root area, generally improved flow conditions in the inter-stage area, lower centrifugal forces and ease of assembly. The separation of the retaining function from the sealing function according to the present invention provide for a considerable saving in mass

11 Claims, 5 Drawing Sheets

RETAINING ARRANGEMENT FOR ROTOR BLADES OF AXIAL-FLOW TURBOMACHINERY

BACKGROUND OF THE INVENTION

This invention relates to a retaining arrangement for rotor blades of axial-flow turbomachinery according to the generic part of claim 1.

Various retaining mechanisms for rotor blades of axial-flow turbomachinery are known in the prior art. Generally, the rotor blades of a turbine stage are fixed in slots provided for this purpose on the circumference of a rotor disk. In these designs, the blade roots are drop-shaped or of the dovetail-type to enable the individual blades to be easily fitted axially into corresponding slots on the circumference of the rotor disk. The blade roots are tapered to retain the individual blades in the rotor disk in the radial direction. To prevent the rotor blades from being displaced in the axial direction, set screws are used, for example, to secure them in their location. In other retaining mechanisms, clamping pins are provided to produce a corresponding fixation in the axial direction.

A further retaining arrangement for rotor blades known in the prior art features slots with firtree-shaped serrations on the circumference of a rotor disk. Into these slots, the corresponding blade roots, which also feature a firtree-shaped serration, are fitted in the axial direction. This fixation arrangement is slightly conical in the axial direction so that the blade can fitted or removed in one direction only. To prevent the blade from unintentionally getting loose and detached from the blade root location, the blade root according to this state of the art is secured in its position by locating plates.

Such locating plates are taught in Specification EP 0761930 A1, for example. These locating plates are costly in terms of manufacture and require special tooling for assembly. The high mass of the locating plates entails high centrifugal forces.

In order to improve the flow conditions between the individual blade stages, Specification U.S. Pat. No. 4,846,628 proposes a continuous, circumferential locating and sealing ring which features projections on its inner circumference, these projections engaging corresponding jaws on the rotor disk. This locating and sealing ring covers the entire blade root height and has a labyrinth-type seal on its outer circumference. Furthermore, the locating and sealing ring described in said Specification and the blade roots must be positioned precisely relative to each other in the axial direction to enable the circumferential contact seal provided on the locating and sealing to become effective.

A similar locating and sealing ring 90 according to the state of the art is shown in FIG. 9. In the design according to this state of the art, assembly and fixation is accomplished similar to a bayonet lock. Since the locating and sealing ring used in this arrangement also serves as a seal against leakage flow between the rotor 93 and the blades 94, it virtually covers the entire blade root 91 and, due to the circumferential contact seal 92, must be manufactured and assembled with high accuracy. Furthermore, this locating and sealing ring 90 features a labyrinth-type seal 95 on its outer circumference.

The two latter locating and sealing arrangements entail the disadvantage that they are very expensive in terms of the exacting manufacturing and assembly tolerances. The high mass entailed by these arrangements compromises the achievable rotational speed and life, respectively.

Specification EP 0463955 B1 teaches an embodiment providing a circumferential retaining ring for rotor blading, this circumferential retaining ring covering the major part of the blade root. However, neither the design nor the method of functioning is further described for this state of the art.

BRIEF SUMMARY OF THE INVENTION

In a broad aspect, the present invention provides a retaining arrangement for rotor blades of turbomachinery which avoids the disadvantages of the state of the art. More particularly, the present invention relates to a cost-effective retaining arrangement which provides for better control of the leakage flow in the blade root area, generally improved flow conditions in the inter-stage area, smaller centrifugal forces and ease of assembly.

It is a particular object of the present invention to provide a retaining arrangement according to the features expressed in claim 1. Further advantageous aspects of the present invention are cited in the subclaims.

The retaining arrangement for rotor blades of axial-flow turbomachinery with the features of claim 1 according the present invention provides for cost effectiveness, improved control of leakage flow in the blade root area, generally improved flow conditions in the inter-stage area, lower centrifugal forces and ease of assembly. Since the locating function which is provided by the retaining ring according to the present invention is separated from the sealing function which, by way of the retaining ring according to the present invention, is provided via corresponding sealing faces between blade and rotor disk, a substantial saving in mass is achieved. In addition, the omission of contact or labyrinth-type seals permits larger manufacturing and assembly tolerances. In this design, the retaing function is provided by projecting sections on the outer circumference of the retaining ring, these projecting sections acting together with corresponding blade root sections. The following direction indications assume the rotor disk to be the reference system.

In alternative developments of the present invention, the projecting sections provided on the outer circumference of the retaining ring may be designed either according to claim 2 or according to claim 4. The design of the projecting sections governs the design of the corresponding blade root sections according to claim 3 or according to claim 5. Other than in the embodiments of claim 2 and 3, the projecting section provided on the outer circumference of the retaining ring according to the embodiment of claim 4 and 5 is fitted sidewards into a corresponding location on the blade root. Since the retaining ring can easily be fitted with conventional assembly tooling, the present invention dispenses with the expenditure for special tooling.

In a beneficial embodiment of the present invention with the features of claim 6, a locking arragnement which functions similar to a bayonet-type lock is provided for the retaining ring.

The embodiment of the present invention according to claim 7 is particularly advantageous. This embodiment provides for a considerable saving in mass which reduces both the manufacturing costs and the centrifugal forces and enables higher rotational speeds to be achieved. In addition, the reduced coverage of the blade root enables flow ducts to be provided in the blade root area which, by passing through the blade root area, improve the flow and cooling conditions between the rotor stages.

In an advantageous embodiment of the present invention with the features of claim 8, a locking block may be provided, for example, which is fitted between two hooks of the locking arrangement. The locking block may be secured against unintentional detachment by way of lockwires, for example. For redundancy reasons, several locks of this type are normally provided on a rotor stage.

The design of the blade/disk sealing surface according to claim 9 dispenses with additional seals on the retaining ring according to the present invention. The manufacture of the sealing faces at the bottom of the blade platform and the rotor lobes does not require additional operations since it can be accomplished in the course of re-machining of the respective parts. Inaccuracies in the axial positioning of the blades do not adversely affect the sealing performance in this embodiment.

The design of the blade root slot in accordance with the features of claim 10 is particularly advantageous. In particular, a serration of the firtree type which tapers in the axial direction is favorable. Moreover, the retaining arrangement here described is suitable for both compressor and turbine stages. Its application in a turbine stage is, however, particularly advantageous.

BRIEF DESCRIPTION OF THE DRAWINGS

Further aspects and advantages of the present invention are described more fully in the light of the embodiments shown on the accompanying drawings, in which.

DETAILED DESCRIPTION OF THE INVENTION

Figure 1:
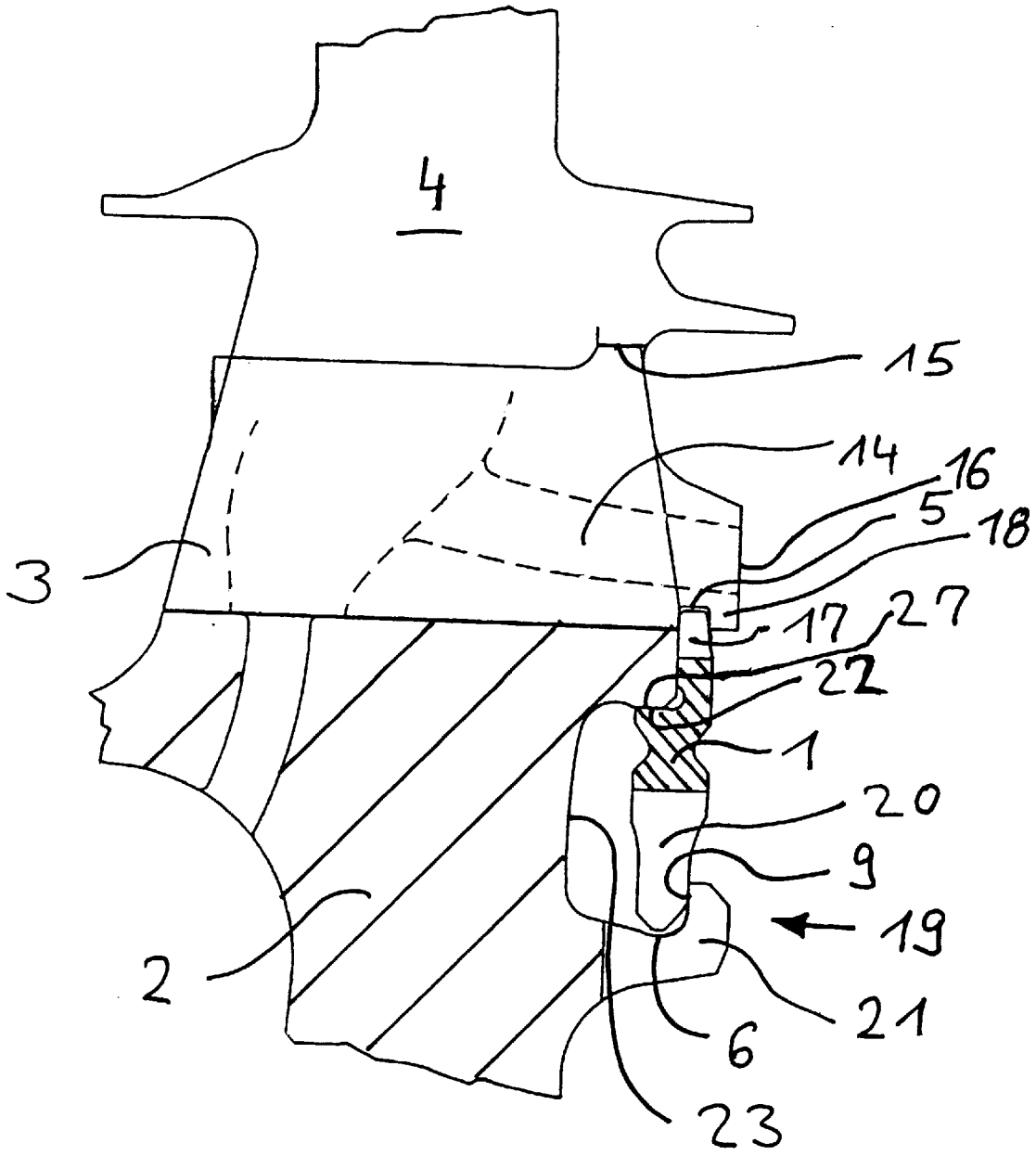
FIG. 1 is a schematic sectional view of an advantageous embodiment of the present invention.

The FIGS. 1 to 6 illustrate a first advantageous embodiment of the present invention. Here, FIG. 1 is a schematic sectional view of the retaining arrangement showing a sectional detail of a rotor disk 2. On the outer circumference of the rotor disk 2, a blade 4 is shown also in sectional detail. The blade 4 is held via a blade root 3 in a blade root slot 12 provided on the outer circumference of the turbine disk 2, this arrangement providing for blade fixation in the radial direction. Against axial displacement, the blade 4 is secured by a retaining ring 1. Also, a flow duct 14 in the area of the blade root 3 is shown by broken lines which contributes to the improvement of the inter-stage flow conditions. The incorporation of an appropriate flow duct 14 is essentially enabled by the design of the retaining ring 1 according to the present invention since it covers less than a third, in the present case approximately an eighth, of the blade root height. Therefore, the exit port 16 of the flow duct 14 is free enabling cooling air to pass unhindered from the flow duct 14 into the disk interspace subsequent to the rotor disk 2.

In the embodiment according to the present invention, the retaining function and the sealing function are separated from each other. In the present embodiment, the sealing function for the prevention of leakage flow is provided by a blade/disk sealing face 15. This blade/disk sealing face 15 is provided as fitting surface between the bottom 26 of the blade platform and the top of the disk lobes 25 located between the blade root slots 12.

The continuous, circumferential features inward projecting sections 20 on its inner circumference which engage hooks 21 projecting from the turbine disk 2. The hooks 21 are made up of a rail 6 which protrudes vertically from the rotor disk 2 and which is interrupted circumferentially (cf. FIG. 3) and of a stop 9 which is parallel to the turbine disk 2 (and which is also interrupted circumferentially—cf. FIG. 3), i.e. the hooks are regularly spaced in the circumferential direction on the rotor disk 2. The rotor disk 2 features a circumferential channel 23 below the blade root slot 12 (as viewed in the axial direction) which, at its bottom end, extends into the (circumferentially interrupted) rail 6. At its top end, the channel 23 features a machined locating face 27 which corresponds with a shoulder 22 of the retaining ring 1. The radially inward projecting sections 20 and the hooks 21 virtually act together like a bayonet-type lock.

Figure 2:
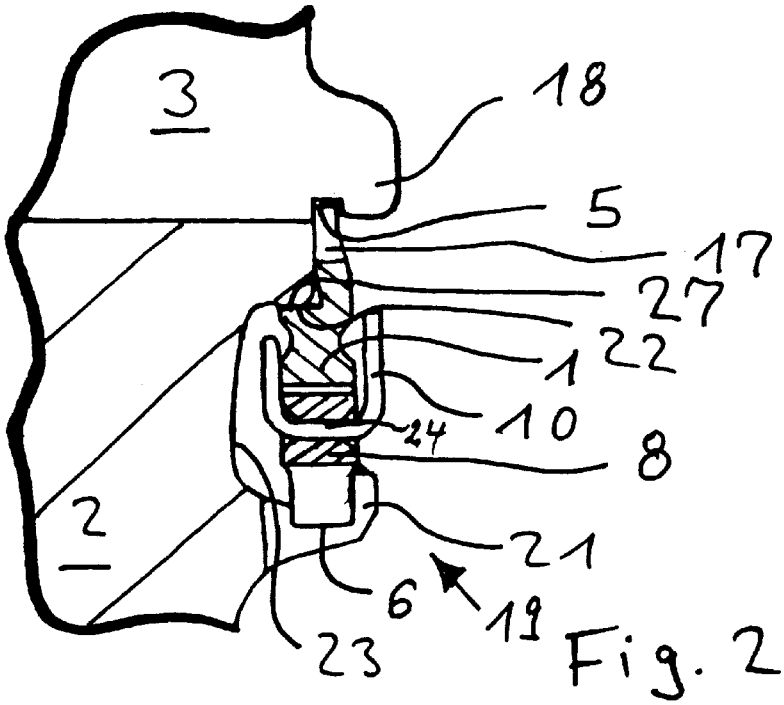
FIG. 2 is a detail view of the embodiment of the retaining arrangement of the present invention shown in FIG. 1.

The retaining ring 1 is shown in detail in FIG. 2. In the area of the outer circumference, the retaining ring 1 features the step-shaped shoulder 22 already mentioned above. This shoulder 22, together with the machined locating face 27 of the channel 23, forms a guide for the retaining ring 1, enabling projecting sections 17 located on the outer circumference of the retaining ring 1 to be precisely introduced in a track or locating groove 5, respectively, of a projecting retaining nib 18 of the blade 4. FIG. 2 also illustrates a locking device 8 for securing the retaining ring 1 in the circumferential direction. The locking device 8 essentially consists of a square block which can be fitted into the recesses formed between the radially inward projecting sections 20 on the inner circumference of the retaining ring 1. The locking device 8 is secured against axial displacement by lockwires 10, each passed through holes 24 at both ends of the locking device 8, as illustrated in the perspective view of FIG. 6. The principal design of the retaining ring 1 becomes apparent from the detail view of FIG. 3.

Figure 3:
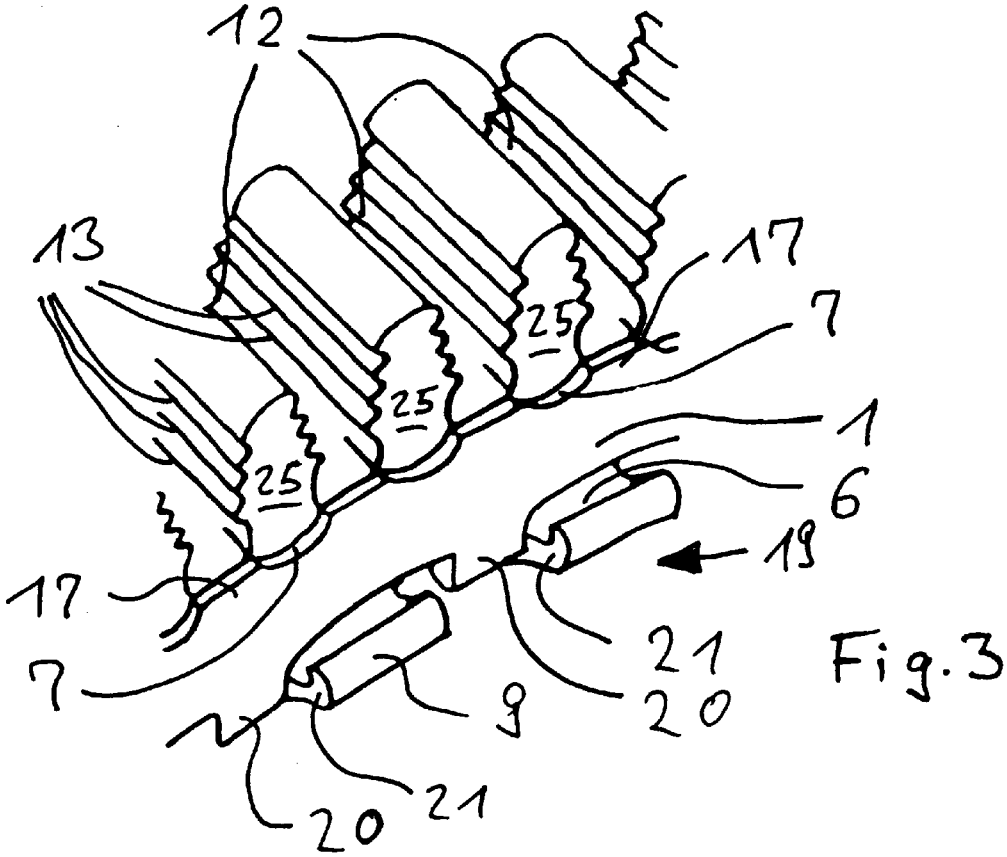
FIG. 3 is a perspective view of the embodiment of the present invention shown in FIG. 1 illustrating a first assembly step.

For assembly, the retaining ring 1 is first put against the rotor disk 2, as illustrated in the perspective view of FIG. 3. In doing so, each of the radially inward projecting sections 20 of the retaining ring 1 is positioned between two hooks 21 of the rotor disk 2. The blade root slots 12 on the outer circumference of the rotor disk 2 here feature a firtree serration 13.

Figure 4:
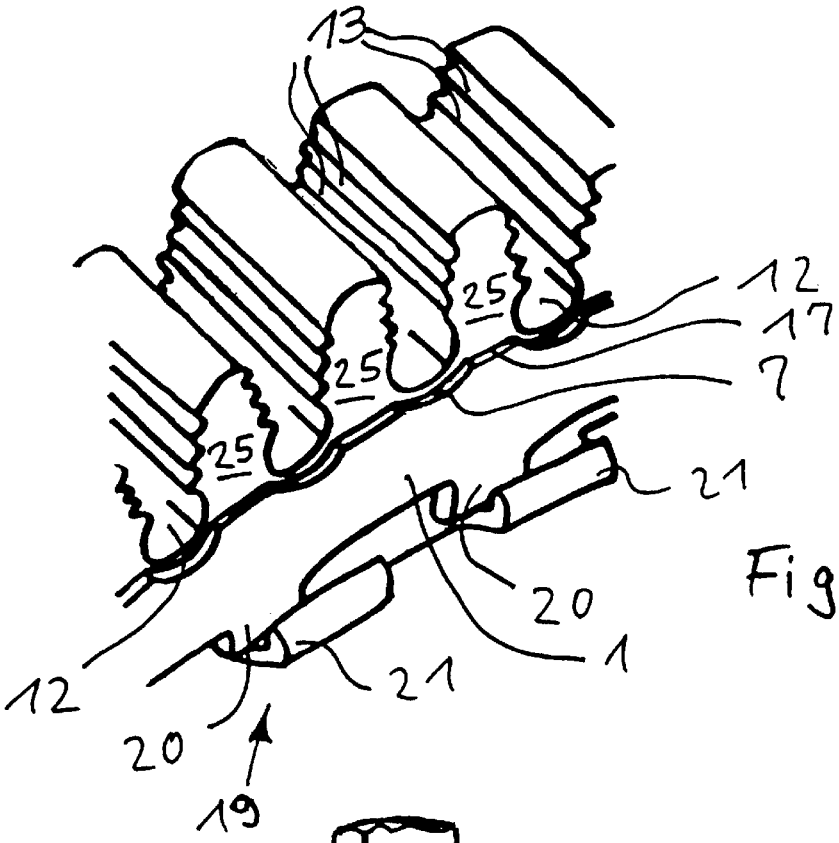
FIG. 4 is a second perspective view of the embodiment of the present invention shown in FIG. 1 illustrating a second assembly step.
Figure 5:
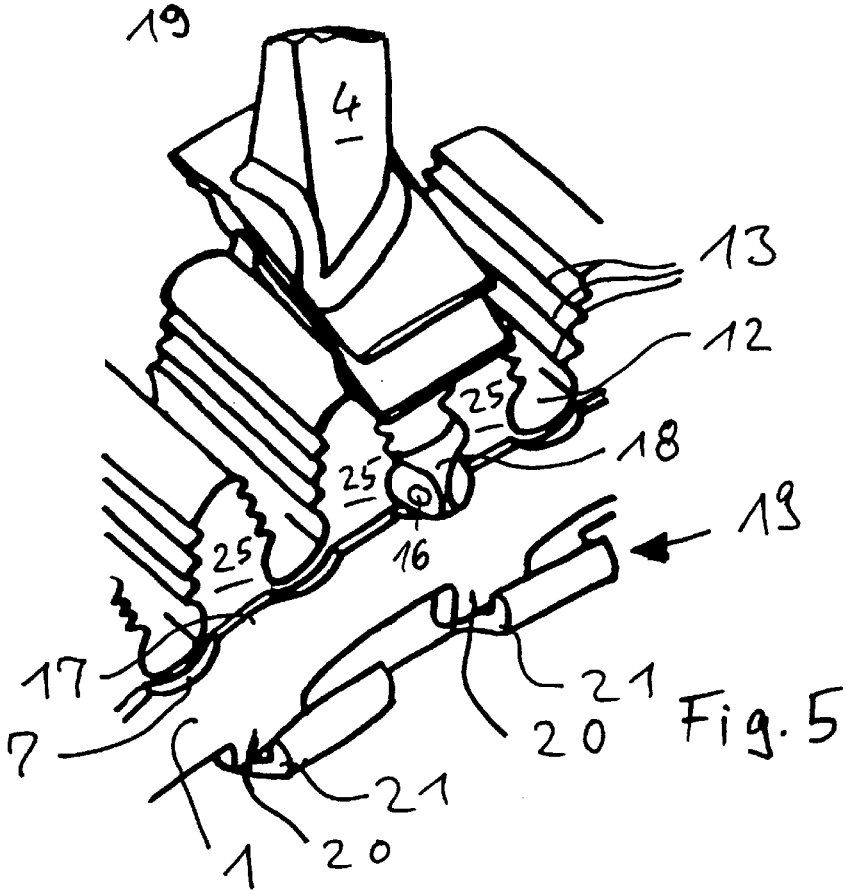
FIG. 5 is a third perspective view of the embodiment of the present invention shown in FIG. 1 illustrating a third assembly step.

As illustrated in FIG. 4, the retaining ring 1 is then moved circumferentially to completely clear the blade root slots 12. As this is done, the radially inward projecting sections 20 on the inner circumference of the retaining ring 1 will partly engage the hooks 21 on the rotor disk 2. Subsequently, the blade 4 is fitted into the blade root slot 12, as shown in the example of FIG. 5 for one blade. The blade 4 here features a retaining nib 18 in the area of the blade root 3 which comprises the locating groove 5 shown in FIGS. 1 and 2. By further rotation in circumferential direction, the projecting sections 17 on the outer circumference of the retaining ring 1 are engaged to the corresponding locating grooves 5. This provides for axial fixation of the blades 4 in the blade root slots 12. Moreover the exit port 16 of the flow duct illustrated in FIG. 1 is provided, or shown, on the retaining nib 18.

Figure 6:
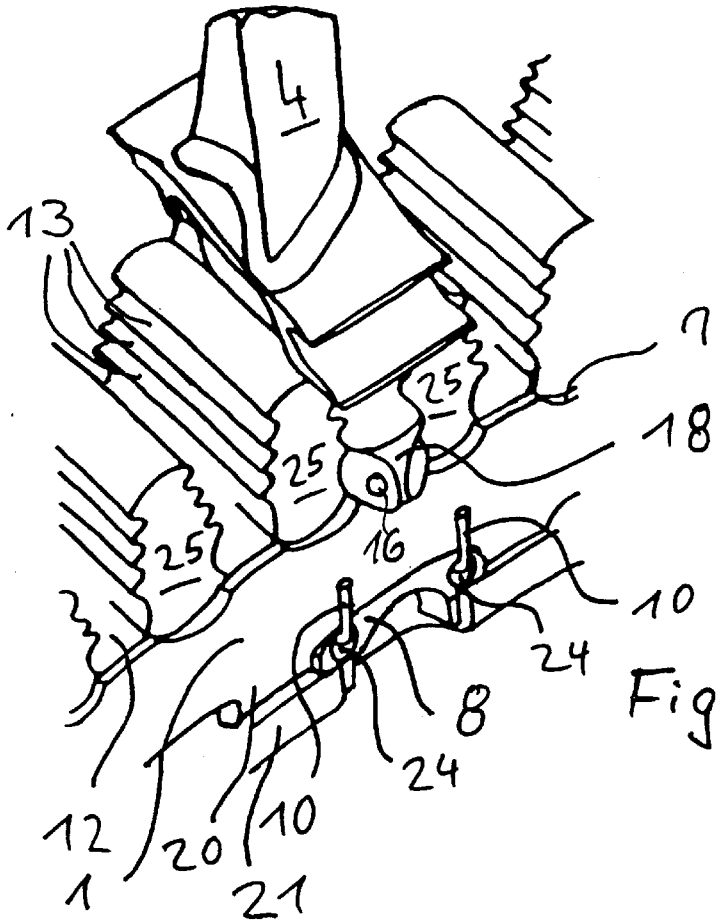
FIG. 6 is a fourth perspective view of the embodiment of the present invention shown in FIG. 1 illustrating the finish-assembled state.

Upon installation of the locking device 8 and the lockwires 10, the blade 4 is connected to the rotor disk 2 securely and ready for operation, as illustrated in the example of FIG. 6 for one blade.

Figure 7:
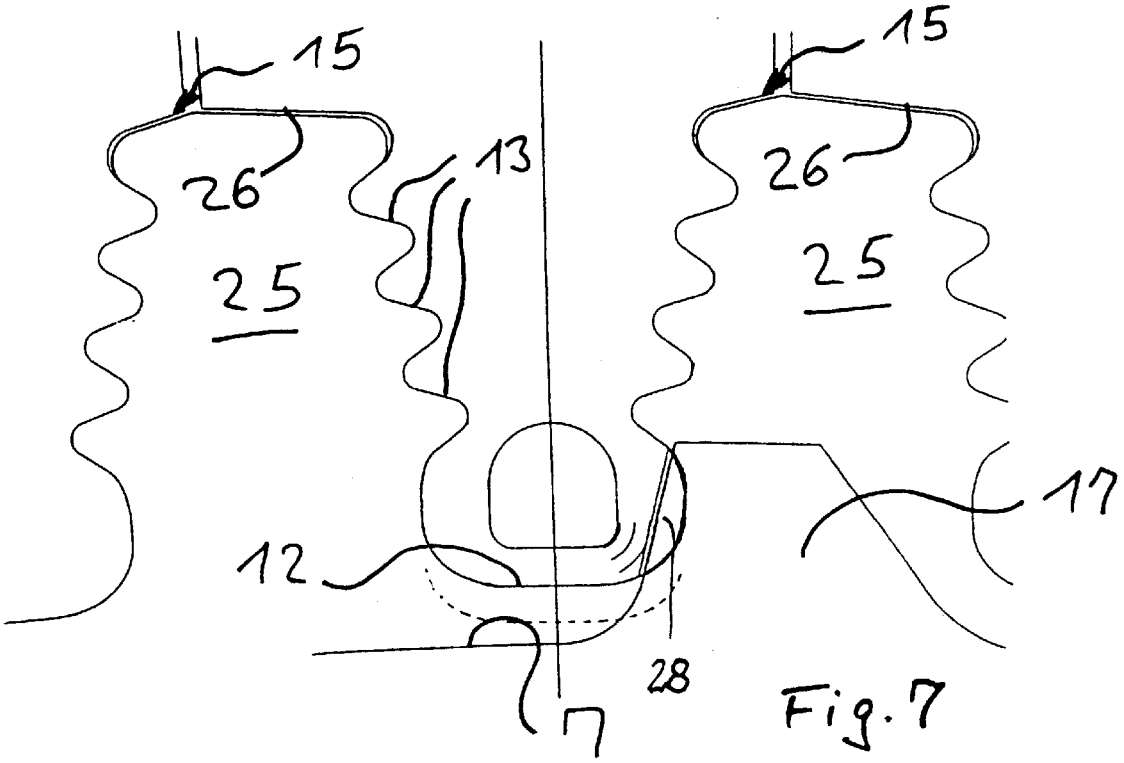
FIG. 7 is a detail of a second advantageous embodiment of the present invention in which the retaining ring has saw-tooth shaped projecting sections.
Figure 8:
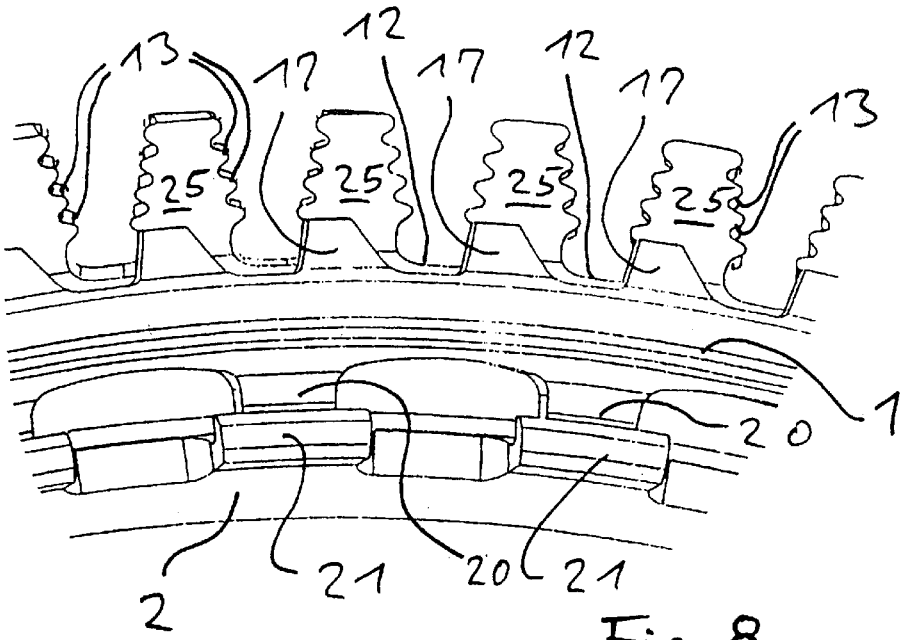
FIG. 8 is a schematic view of the second embodiment of the present invention in axial direction.

The FIGS. 7 and 8 illustrate a second embodiment of the present invention. In these Figures, identical or similar parts are indicated with the same reference numerals. In this embodiment, the projecting sections 17 on the outer circumference of the retaining ring 1 are saw-tooth shaped. The saw-tooth shaped projecting sections 17 can be engaged sidewards with corresponding sideward recesses 28 on the blade root 3, as schematically shown in FIG. 7.

Figure 9:
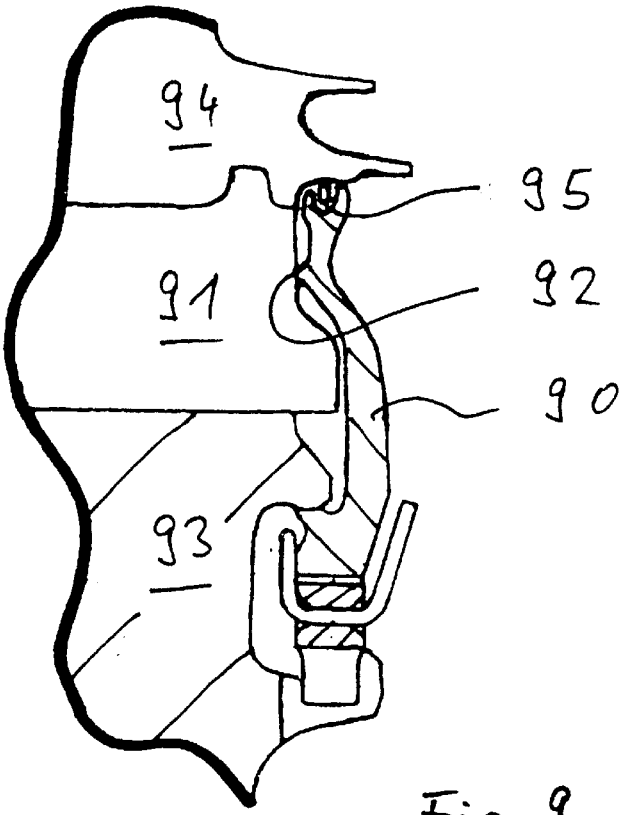
Fig. 9 (PRIOR ART)
FIG. 9 is a locating and sealing ring according to the state of the art.

FIG. 7 further shows the blade/disk sealing faces 15 which provide the function of the contact seal 91 of the state of the art shown in FIG. 9.

FIG. 8 is a view of the retaining ring 1 featuring saw-tooth type projecting sections 17. The retaining ring 1 is assembled analogically to the description for FIGS. 1 to 6. For assembly, each of the radially inward projecting sections 20 is positioned between two hooks 21 of the rotor disk 2. The blade root slots 12 on the outer circumference of the rotor disk 2 here have a firtree serration 13. Upon fitting the blades (not shown) into the blade root slots 12, the retaining ring 1 is secured axially in the hooks 21 similar to a bayonet-type lock. Subsequently, a locking device (not shown) is fitted in the recesses between the radially inward projecting sections 20 to secure the retaining ring 1.

| List of reference numerals | |
|---|---|
| 1 | Retaining ring |
| 2 | Rotor disk |
| 3 | Blade root |
| 4 | Blade |
| 5 | Locating groove |
| 6 | Rail |
| 7 | Recess |
| 8 | Locking device |
| 9 | Stop |
| 10 | Lockwire |
| 11 | ??? |
| 12 | Blade root slot |
| 13 | Serration |
| 14 | Flow duct |
| 15 | Blade/disk sealing face |
| 16 | Exit port of flow duct |
| 17 | Projecting section |
| 18 | Retaining nib |
| 19 | Locking arrangement |
| 20 | Radially inward projecting section |
| 21 | Hook |
| 22 | Shoulder |
| 23 | Channel |
| 24 | Hole |
| 25 | Disk lobe |
| 26 | Bottom of blade platform |
| 27 | Locating face |
| 28 | Sideward recess |
| 90 | Locating and sealing ring |
| 91 | Blade root |
| 92 | Contact seal |

-continued

| List of reference numerals | |
|---|---|
| 93 | Rotor |
| 94 | Blade |
| 95 | Labyrinth-type seal |

What is claimed is:

1. A retaining arrangement for rotor blades of axial-flow turbomachinery comprising:

a rotor disk including blade root slots for the accommodation and radial fixation of rotor blades;

a continuous, circumferential retaining ring for the axial fixation of the rotor blades in the blade root slots; and a locking arrangement for axial retention of the retaining ring, wherein the retaining ring has recesses which correspond with sections of the blade root slots and projecting sections on its outer circumference.

2. A retaining arrangement of claim 1, wherein the projecting sections on the outer circumference of the retaining ring are trapezoidal with sectionally curvilinear flanks.

3. A retaining arrangement of claim 1, wherein a retaining nib protrudes axially on a bottom third of a root of each rotor blade and includes a locating groove for the accommodation of the projecting sections on the outer circumference of the retaining ring.

4. A retaining arrangement of claim 1, wherein the projecting sections on the outer circumference are of a saw-tooth type.

5. A retaining arrangement of claim 4, wherein roots of the rotor blades have sideward recesses in their bottom thirds adapted to engage the saw-tooth shaped sections of the retaining ring.

6. A retaining arrangement of claim 1, wherein the locking arrangement is provided by radially inward projecting sections on the retaining ring and corresponding hooks protruding axially from the rotor disk.

7. A retaining arrangement of claim 1, wherein the retaining ring covers less than a third of the height of each blade root.

8. A retaining arrangement of claim 1, wherein a locking device is provided for circumferential retention of the retaining ring.

9. A retaining arrangement of claim 1, wherein the rotor disk includes a disk lobe protruding from the circumference of the rotor disk between each of adjacent pairs of blade root slots, each rotor blade includes a blade platform and a sealing face is provided both on a top of each disk lobe and on a bottom of each blade platform.

10. A retaining arrangement of claim 1, wherein the blade root slot has a serration.

11. A retaining arrangement of claim 1, wherein the rotor disk includes a radially inwardly facing locating face positioned radially inward of the blade root slots and the retaining ring includes a shoulder having a radially outwardly facing portion, the locating face constructed and arranged to engage the radially outwardly facing portion of the retaining ring shoulder.

* * * * *